US007478880B2

(12) United States Patent
Johnson et al.

(10) Patent No.: US 7,478,880 B2
(45) Date of Patent: Jan. 20, 2009

(54) MULTI-PURPOSE ADJUSTMENT CHAIR MECHANISM

(75) Inventors: LeRoy Johnson, Lowell, MI (US); Earl Boyer, Spring Lake, MI (US)

(73) Assignee: L&P Property Management Company, South Gate, CA (US)

( * ) Notice: Subject to any disclaimer, the term of this patent is extended or adjusted under 35 U.S.C. 154(b) by 342 days.

(21) Appl. No.: 11/266,146

(22) Filed: Nov. 3, 2005

(65) Prior Publication Data

US 2006/0202529 A1 Sep. 14, 2006

Related U.S. Application Data

(60) Provisional application No. 60/659,667, filed on Mar. 8, 2005.

(51) Int. Cl.
*A47C 1/032* (2006.01)

(52) U.S. Cl. ..... 297/342; 297/344.19

(58) Field of Classification Search ..... 297/342, 297/344.19, 463.1

See application file for complete search history.

(56) References Cited

U.S. PATENT DOCUMENTS

| | | | |
|---|---|---|---|
| 134,627 | A | 1/1873 | Barney |
| 942,818 | A | 12/1909 | Flindall |
| 1,621,520 | A | 3/1927 | Snyder |
| 1,769,242 | A | 7/1930 | Toncray |
| 1,922,418 | A | 8/1933 | Conant |
| 1,987,851 | A | 1/1935 | Holman |
| 2,021,120 | A | 11/1935 | Wilkins |
| 2,446,185 | A | 8/1948 | Masucci et al. |
| 2,855,026 | A | 10/1958 | Simons et al. |
| 2,988,398 | A | 6/1961 | Hamilton |
| 3,090,647 | A | 5/1963 | Moore |
| 3,144,270 | A | 8/1964 | Bilancia |
| 3,235,308 | A | 2/1966 | Conner |
| 3,408,106 | A | 10/1968 | Bolling et al. |
| 3,511,533 | A | 5/1970 | Drabert |
| 3,526,430 | A | 9/1970 | Eldon |
| 3,785,700 | A | 1/1974 | Kubo |
| 3,821,845 | A | 7/1974 | Bailey |
| 3,982,785 | A | 9/1976 | Ambasz |
| 4,054,318 | A | 10/1977 | Costin |
| 4,084,850 | A | 4/1978 | Ambasz |
| 4,221,430 | A | 9/1980 | Frobose |
| 4,327,461 | A | 5/1982 | Wisniewski |
| 4,401,343 | A | 8/1983 | Schmidt |
| 4,491,366 | A | 1/1985 | Silber |

(Continued)

*Primary Examiner*—Milton Nelson, Jr.
(74) *Attorney, Agent, or Firm*—Shook, Hardy & Bacon LLP

(57) ABSTRACT

A multipurpose adjustment mechanism for a synchrotilt chair mechanism and a chair with the mechanism. The synchrotilt chair mechanism is for use on a chair that has a base assembly with an extending pedestal, a seat, and a back. The synchrotilt mechanism includes a chassis that is coupled to the pedestal and a seat plate that is coupled to the chassis and to the chair seat. The seat plate slides relative to the chassis. The synchrotilt mechanism further includes a multipurpose adjustment mechanism that can adjust both the height of the chair as well as the orientation of the seat with respect to the chassis. The multipurpose adjustment mechanism may also lock the seat plate with respect to the chassis, such that the seat will not move when the user reclines the chair.

35 Claims, 8 Drawing Sheets

U.S. PATENT DOCUMENTS 4,555,085 A 11/1985 Bauer
4,560,200 A 12/1985 Giannelli et al.
4,648,654 A 3/1987 Voss
4,648,656 A 3/1987 Kimura
4,687,251 A 8/1987 Kazaoka et al.
4,709,894 A 12/1987 Knoblock et al.
4,718,153 A 1/1988 Armitage et al.
4,720,142 A 1/1988 Holdredge et al.
4,732,424 A 3/1988 Uredat-Neuhoff
4,744,603 A 5/1988 Knoblock
4,776,633 A 10/1988 Knoblock et al.
4,786,081 A 11/1988 Schmidt
4,790,600 A 12/1988 Behringer
4,796,951 A 1/1989 Tamura et al.
4,872,635 A 10/1989 Knoblock et al.
4,938,530 A 7/1990 Snyder et al.
4,981,326 A 1/1991 Heidmann
5,007,678 A 4/1991 DeKraker
5,035,466 A 7/1991 Mathews et al.
5,048,893 A 9/1991 Cowan et al.
5,171,062 A 12/1992 Courtois
5,172,882 A 12/1992 Nini
5,249,839 A 10/1993 Faiks et al.
5,280,998 A 1/1994 Miotto et al.
5,308,145 A 5/1994 Koepke et al.
5,314,237 A 5/1994 Koepke et al.
5,318,345 A 6/1994 Olson
5,333,934 A 8/1994 Knoblock
5,352,022 A 10/1994 Knoblock
5,358,207 A 10/1994 West
5,370,444 A 12/1994 Stulik
5,385,388 A 1/1995 Faiks et al.
5,390,978 A 2/1995 Janisch
5,400,634 A 3/1995 Hendricks
5,427,434 A 6/1995 Hybarger
5,431,360 A 7/1995 Yu
5,439,267 A 8/1995 Peterson et al.
5,464,274 A 11/1995 Golynsky et al.
5,486,035 A 1/1996 Koepke et al.
5,487,591 A 1/1996 Knoblock
5,520,438 A 5/1996 Stulik
5,531,168 A 7/1996 Towfigh
5,540,481 A 7/1996 Roossien et al.
5,567,012 A 10/1996 Knoblock
5,577,807 A 11/1996 Hodge et al.
5,582,460 A 12/1996 Schultz
5,603,551 A 2/1997 Sheehan
5,607,204 A 3/1997 Gryp
5,611,598 A 3/1997 Knoblock
5,630,643 A 5/1997 Scholten et al.
5,630,647 A 5/1997 Heidmann et al.
5,630,649 A 5/1997 Heidmann et al.
5,630,650 A 5/1997 Peterson et al.
5,660,442 A 8/1997 Tornero
5,662,381 A 9/1997 Roossien et al.
5,725,276 A 3/1998 Ginat
5,725,277 A 3/1998 Knoblock
5,746,479 A 5/1998 Bodnar
5,755,488 A 5/1998 Beda et al.
5,755,490 A 5/1998 Lamart
5,772,282 A 6/1998 Stumpf et al.
5,775,774 A 7/1998 Okano
5,782,536 A 7/1998 Heidmann et al.
5,806,930 A 9/1998 Knoblock
5,810,440 A 9/1998 Unwalla
5,826,940 A 10/1998 Hodgdon
5,871,258 A 2/1999 Battey et al.
5,873,634 A 2/1999 Heidmann et al.
5,884,887 A 3/1999 Garelick et al.
5,909,923 A 6/1999 DeKraker
5,909,924 A 6/1999 Roslund, Jr.
5,931,531 A 8/1999 Assmann
5,947,559 A 9/1999 Williams
5,951,109 A 9/1999 Roslund, Jr.
5,961,088 A 10/1999 Chabanne et al.
5,975,634 A 11/1999 Knoblock et al.
5,979,984 A 11/1999 DeKraker
6,000,756 A 12/1999 Hybarger et al.
6,003,943 A * 12/1999 Schneider ..... 297/303.3
6,010,189 A 1/2000 Hybarger et al.
6,010,194 A 1/2000 Cykon
6,015,187 A 1/2000 Roslund, Jr.
6,027,168 A 2/2000 Crossman et al.
6,027,169 A 2/2000 Roslund, Jr.
6,039,397 A 3/2000 Ginat
6,059,363 A 5/2000 Roslund, Jr.
6,062,649 A 5/2000 Nagel et al.
6,079,786 A 6/2000 Kirkland et al.
6,086,153 A 7/2000 Heidmann et al.
6,099,076 A 8/2000 Nagel et al.
6,116,695 A 9/2000 Heidmann et al.
6,120,096 A 9/2000 Miotto
6,135,556 A 10/2000 Chu
6,139,103 A 10/2000 Hybarger et al.
6,361,110 B2 3/2002 Roslund, Jr. et al.
6,523,897 B2 2/2003 Pan
6,619,740 B2 9/2003 Beggs
6,685,267 B1 * 2/2004 Johnson et al. ..... 297/300.1
6,817,668 B2 11/2004 Dekraker et al.
6,923,503 B2 8/2005 Sangiorgio
7,014,262 B2 3/2006 Rossetto et al.
7,066,538 B2 * 6/2006 Machael et al. ..... 297/300.2

* cited by examiner

MULTI-PURPOSE ADJUSTMENT CHAIR MECHANISM

CROSS-REFERENCE TO RELATED APPLICATIONS

This application claims the benefit of U.S. Provisional Application No. 60/659,667, filed Mar. 8, 2005.

STATEMENT REGARDING FEDERALLY SPONSORED RESEARCH OR DEVELOPMENT

None.

BACKGROUND OF THE INVENTION

This invention relates generally to a chair-control mechanism that synchronizes the movement of a chair seat and backrest, and more particularly to a multi-purpose adjustment mechanism for adjusting the orientation of the chair.

Office chairs and chair mechanisms have evolved over time to improve the ergonomic fit and feel for chair occupants and to provide chairs that better meet the usage needs of the occupant. On these types of mechanisms, the back and seat are synchronized so that as the back reclines, the seat moves as well. These synchronized mechanisms are referred to as "synchrotilt" mechanisms. These mechanisms contain different types of adjustment mechanisms that allow the user to achieve multiple different configurations for optimal fit and feel.

While adjustment mechanisms for synchrotilt chairs are known in the art, most of the adjustment mechanisms provide two or more adjustors that can adjust the chair in a number of different ways. Standard adjustors can be either handles, levers, cables, or any combination thereof. Typically, a first adjustor is used to provide the height adjustment capability while another adjustor is used for the seat orientation adjustment. In some instances a third adjustor may also be furnished to provide a "lock out" adjustment where the orientation of the seat is locked with respect to the chassis, thereby prohibiting movement of the chair seat with respect to the chassis. Thus, while many adjustments to the seating configuration can be made by the user, the necessary adjustments require a plurality of adjustors to accomplish the desired fit and feel.

Thus, while adjustment mechanisms with multiple adjustors are known in the art, it would be desirable to provide a multipurpose adjustment mechanism for a synchrotilt chair that combines the multiple adjustors of the known art into a single mechanism that accomplishes all the necessary adjustments. Further, it would be desirable to provide a multipurpose adjustment mechanism for a synchrotilt chair that can accomplish both the height adjustment as well as the seat orientation adjustment.

BRIEF SUMMARY OF THE INVENTION

The present invention is directed to a multipurpose adjustment mechanism for a synchrotilt chair mechanism and a chair with the mechanism. The synchrotilt chair mechanism is for use on a chair that has a base assembly with an extending pedestal, a seat, and a back. The synchrotilt mechanism includes a chassis that is coupled to the pedestal and a seat plate that is coupled to the chassis and to the chair seat. The seat plate slides relative to the chassis. The synchrotilt mechanism further includes a multipurpose adjustment mechanism that can adjust both the height of the chair as well as the orientation of the seat with respect to the chassis. The multipurpose adjustment mechanism may also lock the seat plate with respect to the chassis, such that the seat will not move when the user reclines the chair.

The synchrotilt mechanism further includes a back support bar that is coupled on one end to the chassis. The support bar extends upwardly from the chassis. A pair of arm supports extend upwardly from the seat plate adjacent to each side of the chair seat. The synchrotilt mechanism also includes a back bracket having a pair of ends that extend between the arm supports. The back bracket includes a guide plate with a dovetail section that mounts to the chair back. The dovetail section slidably and pivotally couples the back bracket to the other end of the back support bar. During recline of the chair, the back bracket pivots about the pivot connection on each arm support and the guide plate guides the lower chair back downwardly and forwardly. In addition, during recline the chair seat slides forwardly on the chassis. Additional advantages and novel features of the invention will be set forth in the description which follows and, in part, will become apparent to those skilled in the art upon examination of the following, or may be learned from practice of the invention.

BRIEF DESCRIPTION OF THE SEVERAL VIEWS OF THE DRAWINGS

The present invention is described in detail below with reference to the attached drawing figures, wherein.

DETAILED DESCRIPTION OF THE INVENTION

Figure 1:
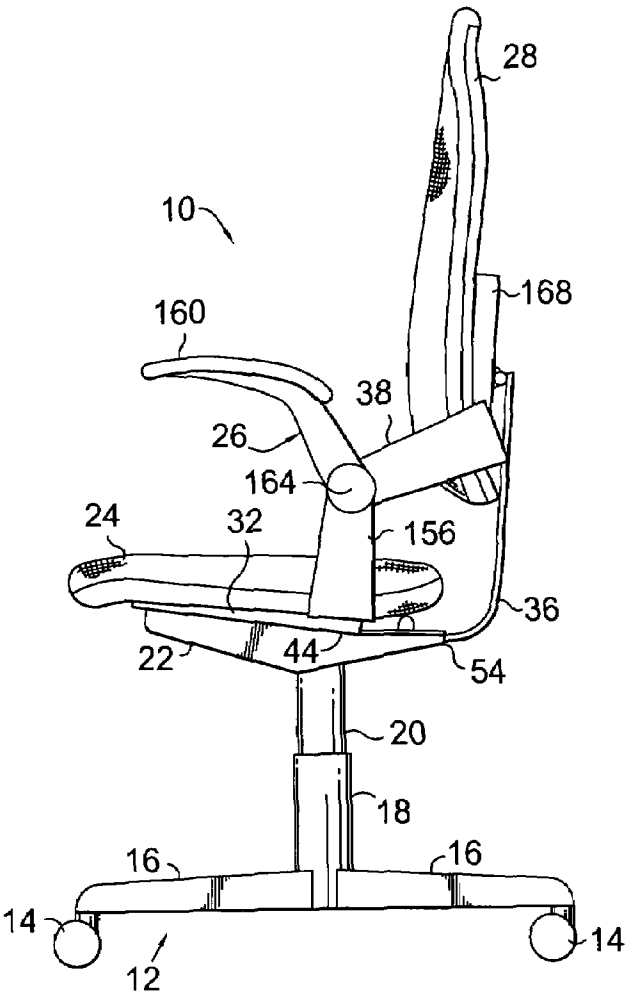
FIG. 1 is a side-elevation view of a chair and mechanism according to the principles of the invention.

With initial reference to FIG. 1, a chair embodying the principles of the invention is generally indicated by reference numeral 10. The chair 10 is equipped with a base assembly 12. The base 12 preferably has a number of castors 14 operably supported on the outer ends of a corresponding number of support legs 16. The support legs 16 converge to a pedestal column 18. Preferably, the pedestal column 18 and the support legs 16 are integrally formed in one piece. The column 18 preferably supports a gas cylinder 20. The gas cylinder 20 allows the height of the chair to be adjusted by an occupant, as is known to those of skill in the art. The construction of the base 12 and column 18 is well known to those of skill in the chair industry.

With continued reference to FIG. 1, a chassis 22 is coupled to the gas cylinder 20. The chassis 22 supports a seat 24 that is slidingly coupled to the chassis 22. A pair of armrests 26 are also coupled to the seat 24. A chair back 28 is coupled to both the armrests 26 and to the seat 24.

Figure 2:
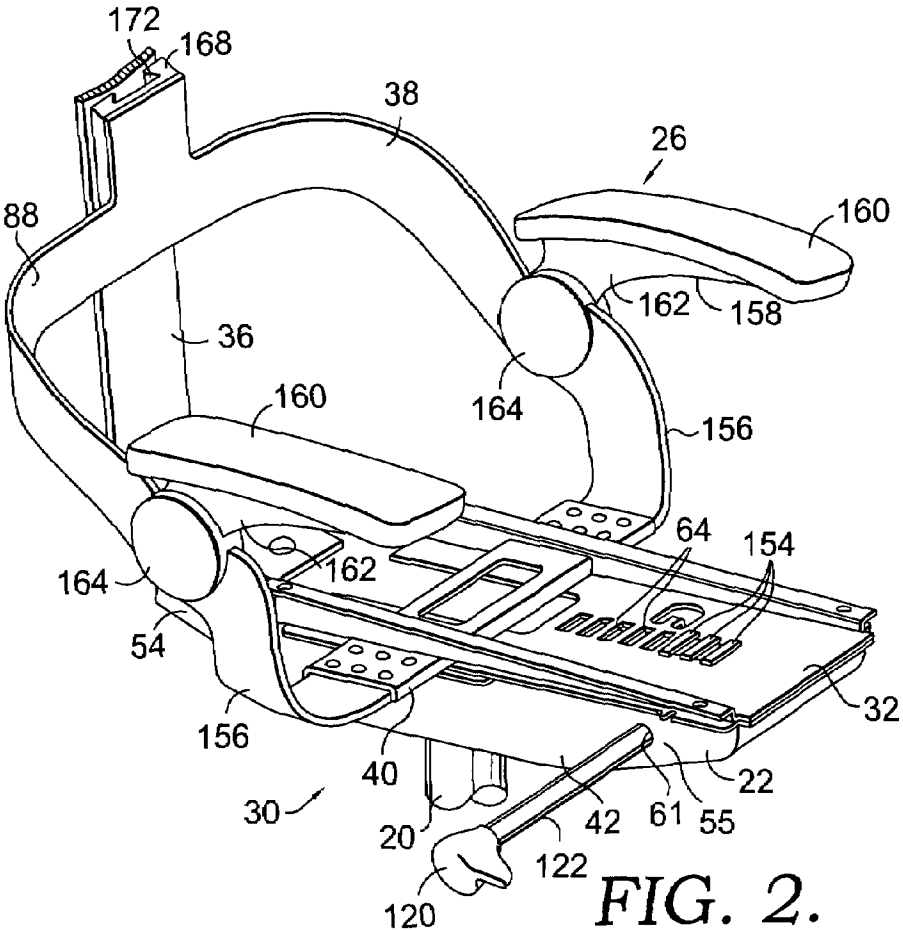
FIG. 2 is a perspective view of the chair of FIG. 1, with the seat and back removed.
Figure 3:
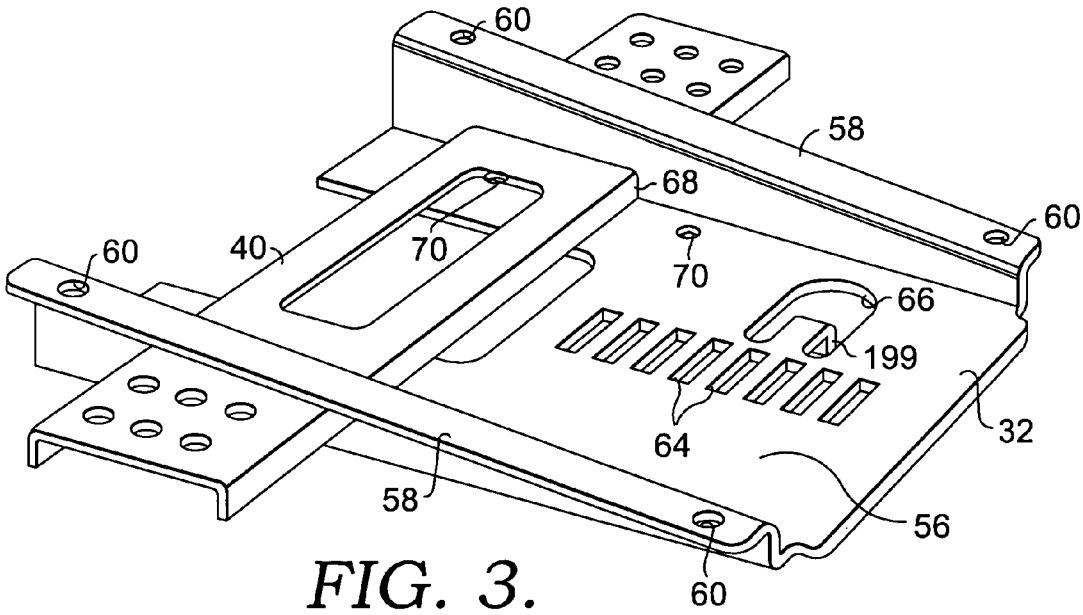
FIG. 3 is a perspective view of a seat plate and an arm mount.
Figure 4:
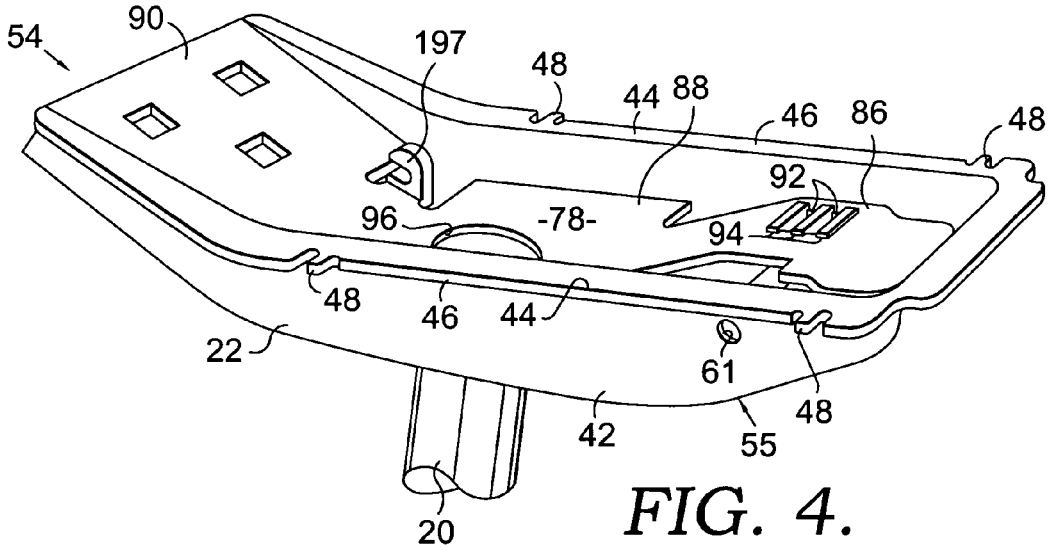
FIG. 4 is a perspective view of a chassis.

Having briefly described the basic elements of chair 10, a more detailed description of the various elements and their connection is described below. FIGS. 2-4 show the various components of a chair mechanism 30. Broadly stated, the chair mechanism 30 includes the chassis 22, a seat plate 32, an adjustment mechanism 34 (FIG. 6), a J-back support bar 36, a back bracket 38, an arm mount 40, and a pair of armrests 26. The chassis 22 includes a hole in its bottom, not shown, that accommodates an upper portion of gas cylinder 20. The upper portion of cylinder 20 is then secured to chassis 22 so that as the cylinder 20 extends and retracts, the chassis 22 correspondingly moves up and down. Preferably, this coupling is accomplished via a tapered bushing, as is known to those of skill in the art.

Figure 5:
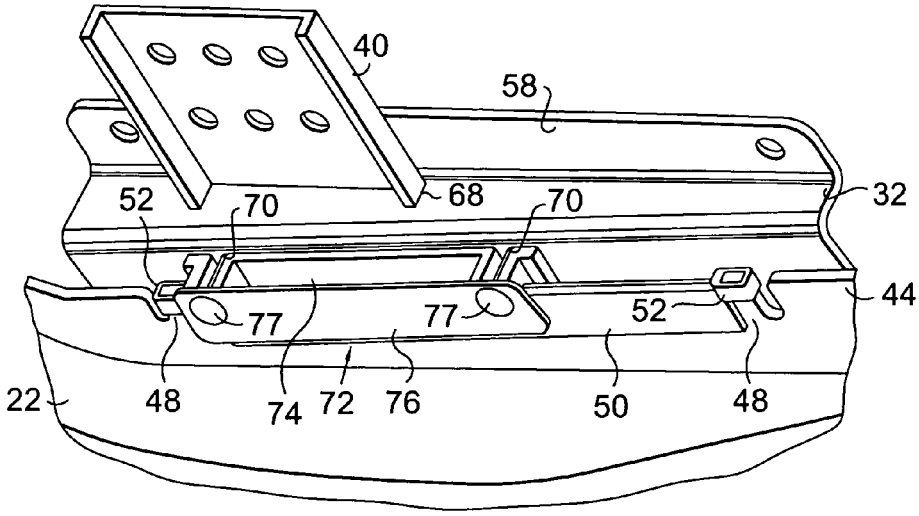
FIG. 5 is a partial, enlarged perspective view of a coupling assembly between the seat plate and the chassis.

Referring now to FIGS. 4 and 5, the chassis 22 will now be discussed. The chassis 22 is preferably a stamped or cast-metal piece and includes a body 42 and a pair of flanges 44 that extend outwardly from body 42. The upper surface of flanges 44 forms a plane that inclines slightly upwardly from the rear of the chair to the front of the chair. Each flange 44 includes a recess 46 that extends generally from the rear of the chassis 22 toward the front of the chassis 22 and a pair of stops 48. A C-shaped slide member 50 is fixably coupled to each recess 46. The C-shaped slide member 50 extends between the pair of stops 48 along the length of each recess 46. An absorbing member 52 is attached to each stop 48. The body 42 also includes a rear mounting section 54 and a front mounting section 55. As best seen in FIGS. 1 and 2, the rear mounting section 54 is used to mount the J-back support bar 36 to the chassis 22. Referring again to FIG. 4, the front mounting section 55 consists of a pair of mounting holes 59, not shown, 61 the importance of which will be described below.

Referring now to FIGS. 2, 3, and 5, the seat plate 32 will be discussed. The seat plate 32 is slidingly coupled to chassis 22. Seat plate 32 is also preferably a stamped or cast-metal piece. The seat plate 32 has a central section 56 and a pair of extending flanges 58. Each flange 58 has a pair of apertures 60. Generally, one aperture 60 is located near the rear edge of flange 58 and the other aperture 60 is located near the forward edge of flange 58. The central section 56 of the seat plate 32 is generally sloped downwardly from the front to the rear and contains a series of slots 64 spaced from the front of the central section 56 toward the rear. The slots 64 provide one component of the adjustment mechanism 34, as is further described below. The central section 56 includes another aperture 66, shaped as shown, the importance of which will be described further below. The central section 56 further includes a mount channel 68 located on each side near the rear portion of the seat plate 32. The mount channel 68 is shaped as shown and sized for receipt of the arm mount 40. The central section 56 also includes a set of attachment holes 70 located on each side near the flanges 58. The attachment holes 70 are used to affix a coupling assembly 72.

As best shown in FIG. 5, the coupling assembly 72 attaches the seat plate 32 to the chassis 22. The coupling assembly 72 includes a slide block 74, a bracket 76, and a pair of bolts 77. The bracket 76 contains a pair of holes, not shown, that align with a pair of apertures in the slide block 72 and the attachment holes 70. The bolts 77 are used along with the bracket 76 and attachment holes 70 to attach the slide block 74 to the seat plate 32. Preferably, the slide block 74 and the slide member 50 are made from a material that will facilitate the relative sliding movement between seat plate 32 and chassis 22. One such acceptable material is acetal. Other suitable materials that facilitate the sliding movement while resisting wear could, of course, be used. As can be understood, the seat plate 32 is able to move relative to the chassis 22. As the seat plate 32 moves forwardly relative to the chassis 22, the slide block 74 moves along the C-shaped slide member 50 attached to the recess 46. As shown in FIGS. 4 and 5, the length of recess 46 determines the range of motion of the seat plate 32 relative to the chassis 22. Additionally, as shown in FIG. 1, the seat plate 32 is fixably coupled to the seat 24 so that as the seat plate 32 moves, the seat 24 moves correspondingly.

Figure 6:
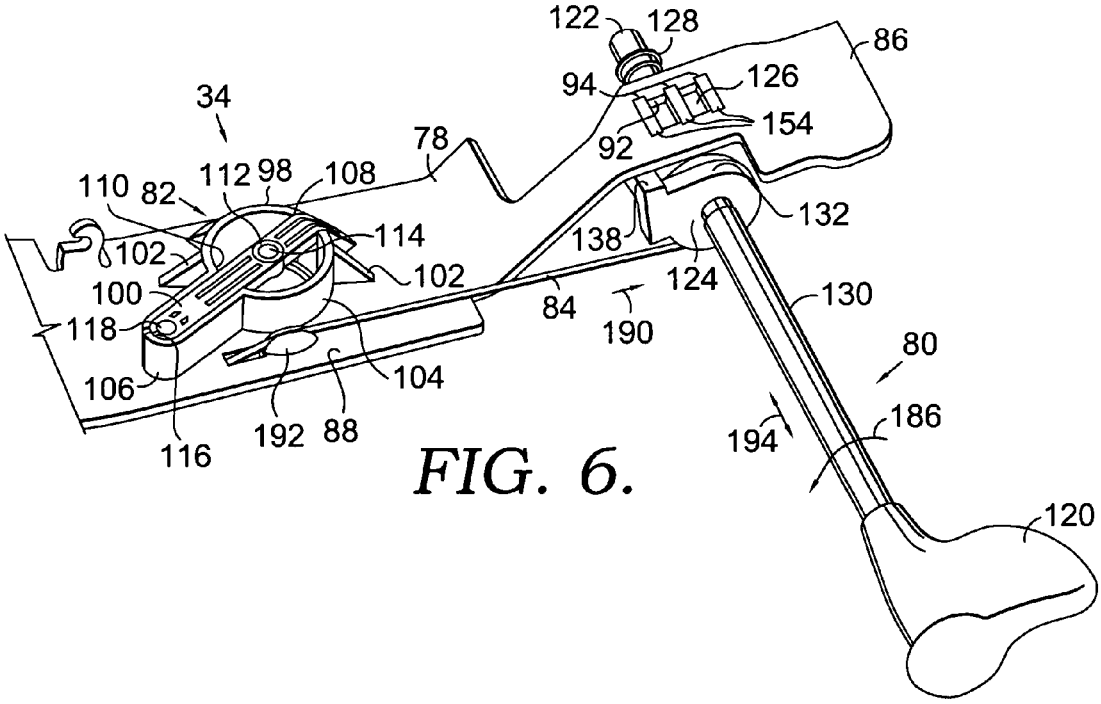
FIG. 6 is a partial, perspective view of an adjustment mechanism.

Referring now to FIG. 6, the adjustment mechanism 34 will be discussed. The adjustment mechanism 34 can be used to adjust both the height of the chair 10, the orientation of the seat plate 32 with respect to the chassis 22, and to lock the seat 24 and, thus, the back 28 in place. The adjustment mechanism 34 includes a plate 78, a lever mechanism 80, a height adjustment mechanism 82, and a cable 84. The plate 78 is preferably a stamped or cast-metal piece and shaped as shown. As seen in FIG. 4, the plate 78 is adapted to fit within the body 42 of the chassis 22. Further, as seen in FIG. 2, it should be evident that the adjustment mechanism 34 fits within the body 42 of the chassis 22 with the seat plate 32 slidably coupled to the chassis 22. Referring again to FIGS. 4 and 6, the plate 78 includes a forward portion 86, an intermediate portion 88, and an aft portion 90. The forward portion contains a generally rectangular slot 92 with a plurality of notches 94, the importance of which will be described further below. The intermediate portion 88 includes a hole 96 in its bottom that accommodates an upper portion of gas cylinder 20. When the plate 78 is placed in the body 42 of the chassis 22, the hole 96 aligns with the hole in the bottom of the chassis 22.

As shown in FIG. 6, the height adjustment mechanism 82 includes a receiver 98 and a height adjustment lever 100. The receiver 98 is fixably coupled to an upper surface of the intermediate portion 88 by a number of flanges 102. The receiver 98 is coupled to the plate 78 by weldment or any other suitable attachment method. The receiver 98 extends upwardly from the upper surface of the intermediate portion 88. The receiver 98 includes a collar 104 and a channel 106. The collar 104 is cylindrical, sized to receive the gas cylinder 20, shown in FIGS. 1 and 2, and aligned with the hole 96 in the plate 78, see FIG. 4. The collar 104 further contains a pair of recesses 108, 110 that are aligned and opposed. The recesses 108, 110 are sized to receive the height adjustment lever 100. A first end of the height adjustment lever 100 is rotatably coupled with the first recess 108 and is received within the channel 106. The channel 106 depends outwardly from the second recess 110 and is located opposite the first recess 108. The channel 106 is sized for receipt of a portion of the height adjustment lever 100. The height adjustment lever 100 also contains a threaded aperture 112 located at an intermediate position. The aperture 112 receives a set screw 114, the set screw 114 being adapted to operably engage the gas cylinder 20 for height adjustment. A second end of the height adjustment lever 100 contains a mount 116. A first end 118 of the cable 84 is coupled within the mount 116, the importance of which will be described further below.

Figure 7:
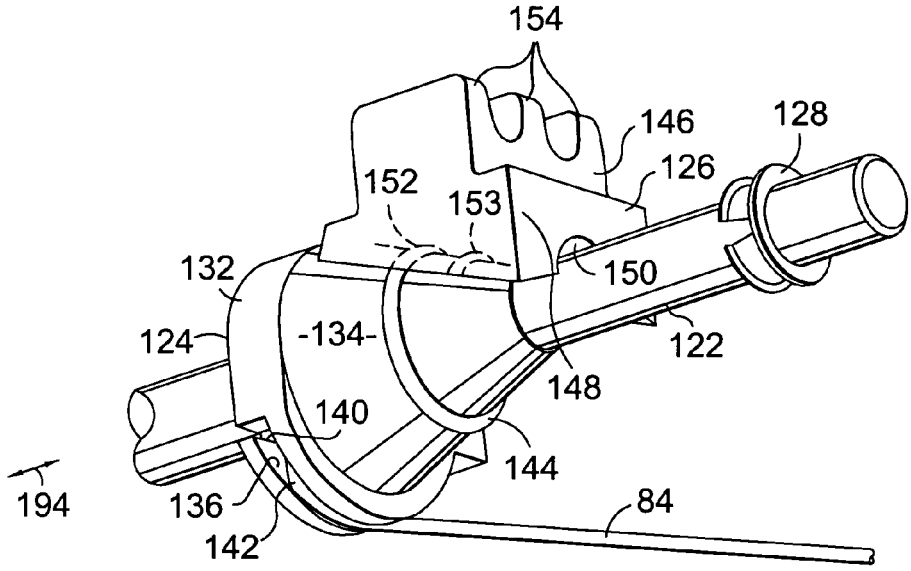
FIG. 7 is a partial, enlarged perspective view of the conical cam and cam follower.

Referring now to FIGS. 6 and 7, the lever mechanism 80 will be discussed. The lever mechanism 80 includes a handle 120, a shaft 122, a conical cam 124, and a block cam follower 126. The handle 120 is fixably coupled to a first end of the shaft 122. As shown in FIGS. 2 and 4, the shaft 122 extends through the body 42 of the chassis 22 and is received within the mounting holes 59, 61 located in the front mounting section 55. Referring again to FIGS. 6 and 7, a second end of the shaft 122 is received within a bushing 128 that is snap fit in the first mounting hole 59. It should be understood that the first mounting hole 59, while not shown, is located opposite the second mounting hole 61 in the front mounting section 55. The conical cam 124 is fixably mounted on the shaft 122 at an intermediate position. A sleeve 130 is received on the shaft 122 and extends between the conical cam 124 and the handle 120. The sleeve 130 and bushing 128 facilitate movement of the shaft 122 within the mounting holes 59, 61.

With continued reference to FIGS. 6 and 7, the conical cam 124 will now be discussed. The conical cam includes an outer edge 132 and a cam surface 134. The outer edge 132 includes a channel 136 and a stop 138. The channel 136 circumscribes a portion of the underside of the outer edge 132 and contains a notch 140 at one end. The notch 140 is suitable for receipt of a second end 142 of the cable 84. The channel 136 serves to guide the cable 84. The stop 138 is located on an upper portion of the outer edge 132 and abuts the underside of the forward portion 86 of the plate 78. The stop 138 serves to limit the rotation of the lever mechanism 80. The cam surface 134 projects inwardly from the outer edge 132. The cam surface 134 tapers inwardly from the outer edge 132 to the shaft 122. The cam surface 134 is conical and contains a ridge 144 that circumscribes the cam surface 134 at an intermediate location.

The block cam follower 126 contains an upper portion 146 and a lower portion 148. The lower portion 148 contains an inner surface 150. The inner surface 150 of the block cam follower 126 interfaces with the cam surface 134 of the conical cam 124. The inner surface 150 contains a pair of parallel recessed grooves 152, 153. The recessed grooves 152, 153 mate with the ridge 144 located on the cam surface 134. The upper portion 146 of the block cam follower 126 contains a plurality of vertical projections 154. The projections 154 extend upwardly from the upper portion 146 and are received within the grooves 94 in the rectangular slot 92 located in the forward portion 86 of the plate 78.

Referring now to FIGS. 1 and 2, attention is directed to the connection of the back to the seat. In the embodiment shown, this is accomplished along with the provision of armrest 26. It should be understood that the armrest 26 itself is not essential. As shown, each armrest 26 includes an L-shaped connecting bracket 156. Each bracket 156 has a lower portion that is fixably coupled to the arm mount 40 which is in turn coupled to the seat plate 32. Thus, the armrests 26 travel with the seat 24. Similarly, each bracket 156 has an upper portion with at least one mounting hole, not shown. Each armrest 26 also contains an armrest extension 158. More specifically, each extension 158 has a pad 160 and a bracket 162 with a hole, not shown, near its lower edge. It will be appreciated by one of ordinary skill in the art that a nut-and-bolt-type arrangement, while not shown, fixably couples the upper end of each arm 156 to the armrest extension 158.

The back bracket 38 then extends between the brackets 156. More specifically, back bracket 38 has a generally U-shaped bridge section 89 that spans the width of the chair back 28. The ends of bridge section 89 extend toward the front of chair 10 and terminate proximate the upper end of each bracket 156. Each terminal end of bridge section 89 has a mounting hole, not shown. It will be appreciated by one of ordinary skill in the art that the nut-and-bolt-type arrangement mentioned above fixably couples the upper end of each bracket 156 to the armrest extension 158 and the back bracket 38 at pivot point 164. In this coupling, the back bracket 38 can rotate about the pivot point 164. Preferably, the pivot point 164 is located in the area corresponding to a properly seated occupant's hip joint.

Figure 8:
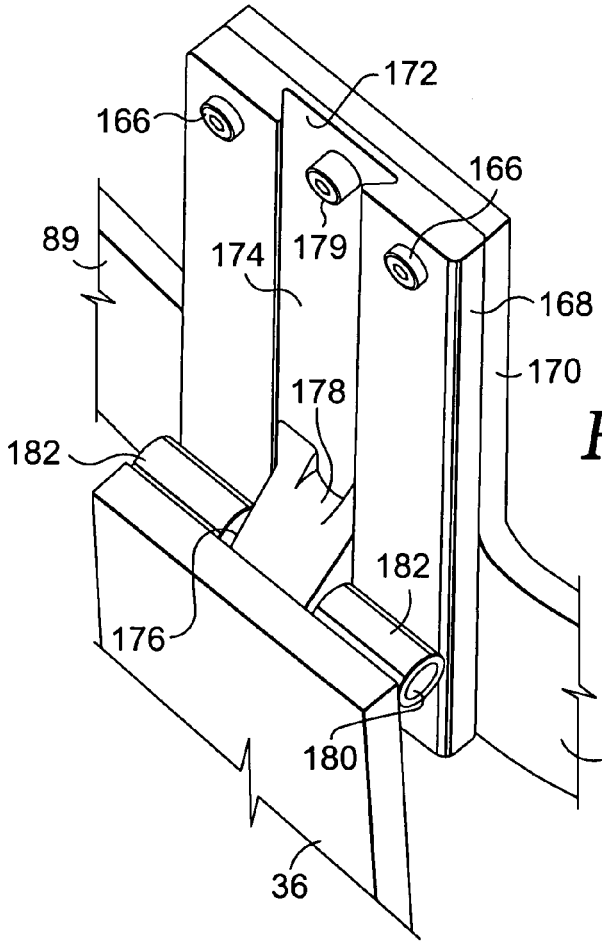
FIG. 8 is an enlarged view of a guide plate of the back bracket with a J-back support bar attached thereto.

Referring now to FIGS. 1, 2, and 8, a plurality of fasteners 166 couple a guide plate 168 to a mounting portion 170 of the bridge section 89. The fasteners 166 are used to secure the guide plate 168 and, thus, the back bracket 38 to the chair back 28. The guide plate 168 and mounting portion 170 are centrally disposed between the two ends of the bridge section 89. The guide plate 168 further has a dovetail section 172 with an elongate dovetail channel 174 that is oriented generally vertically with respect to the chair.

Referring specifically to FIG. 8, the guide plate 168 couples the back bracket 38 to J-back support bar 36 in a sliding manner. More specifically, the upper end of the bar 36 has a dovetail mount 176. The dovetail mount 176 contains a dovetail 178 that mates with the dovetail channel 174 and an axle 180. The ends of the axle 180 extend outwardly from the dovetail 178. The axle 180 can be a single piece coupled to the end of the bar 36 or can be two separate pieces, one of which extends from one side of the dovetail 178 and the other of which extends from the other side of the dovetail 178. A friction-reducing roller 182 is placed on each side of the axle 180.

In the coupling of the back bracket 38 to the J-back support bar 36, the dovetail 178, mounted on the upper end of the J-back support bar 36, slides with respect to the dovetail channel 174. A stop 179 serves to limit the amount of movement between the dovetail 178 and the dovetail channel 174. As shown in FIG. 1, the other end of the J-back support bar 36 is coupled at its lower end to the rear mounting section 54 of the chassis 22. This is a fixed coupling, such as by bolting, welding, and the like.

The operation of the adjustment mechanism 34 is best described with reference to FIGS. 4, 6, and 7. As stated above, the adjustment mechanism 34 can be used to adjust both the height of the chair 10, to adjust the orientation of the seat plate 32 with respect to the chassis 22, and to lock the seat 24 and, thus, the back 28 in place. With specific reference to FIG. 6, the height of the chair is adjusted by rotation of the handle in the counterclockwise direction, as shown by reference numeral 186. A counterclockwise rotation of the handle 120, in turn causes a counterclockwise rotation of the conical cam 124. The rotation of the conical cam 124 creates a forward pulling force, shown by arrow 190 on the cable 84 that is attached within the channel 136 in the outer edge 132 of the conical cam. The forward pulling force 190 on the cable 84 results in a force through the cable 84 in the cable guide 192 located at the intermediate portion 88 of plate 78. The pulling of the cable 84 through the cable guide 192 creates a downward force upon lever 100 through the first end 118 of the cable 84 through mount 116. The downward force through the first end 118 of the cable 84 causes the lever 100 to rotate downwardly about the coupling between the height adjustment lever 100 and the first recess 108. The downward rotation of the lever 100 causes the set screw 114 to operably engage the gas cylinder for height adjustment.

As best seen in FIGS. 6 and 7, to adjust the orientation of the seat plate 32 with respect to the chassis 22 and to lock the seat 24, the handle 120 is moved in the direction indicated by arrow 194. FIGS. 6 and 7 both show the cam follower 126 in a first position where the ridge 144 is located in the first recess 152. The first position allows the seat plate 32 to move freely with respect to the chassis 22. When the handle 120 is pushed inwardly, the cam surface 134 contacts the inner surface 150 of the cam follower 126. As the handle 120 is pushed farther inwardly, the ridge 144 disengages from the first recess 152 and moves inwardly toward the second recess 153. The inward movement of the handle 120 in turn causes the cam surface 134 to contact the inner surface 150, which moves the projections 154 upwardly within notches 94 in the rectangular slot 92. When the projections move upwardly, they project above the surface of the plate 78, see FIG. 4. When the ridge 144 contacts the second recess 153, the projections 154 extend through the notches 94 in the rectangular slot 92 and come into contact with the series of slots 64 in the central section 56 of the seat plate 32, see FIG. 2. Thus, by manipulating the handle 120 in the direction shown by arrow 194 the orientation of the seat plate 32 with respect to the chassis 22 may be adjusted. Further, if the user leaves the handle 120 in the inner-most position where the ridge 144 is in contact with second recess 153, the seat plate 32 and, thus, the seat 24 may be locked with respect to the back 28.

Figure 9:
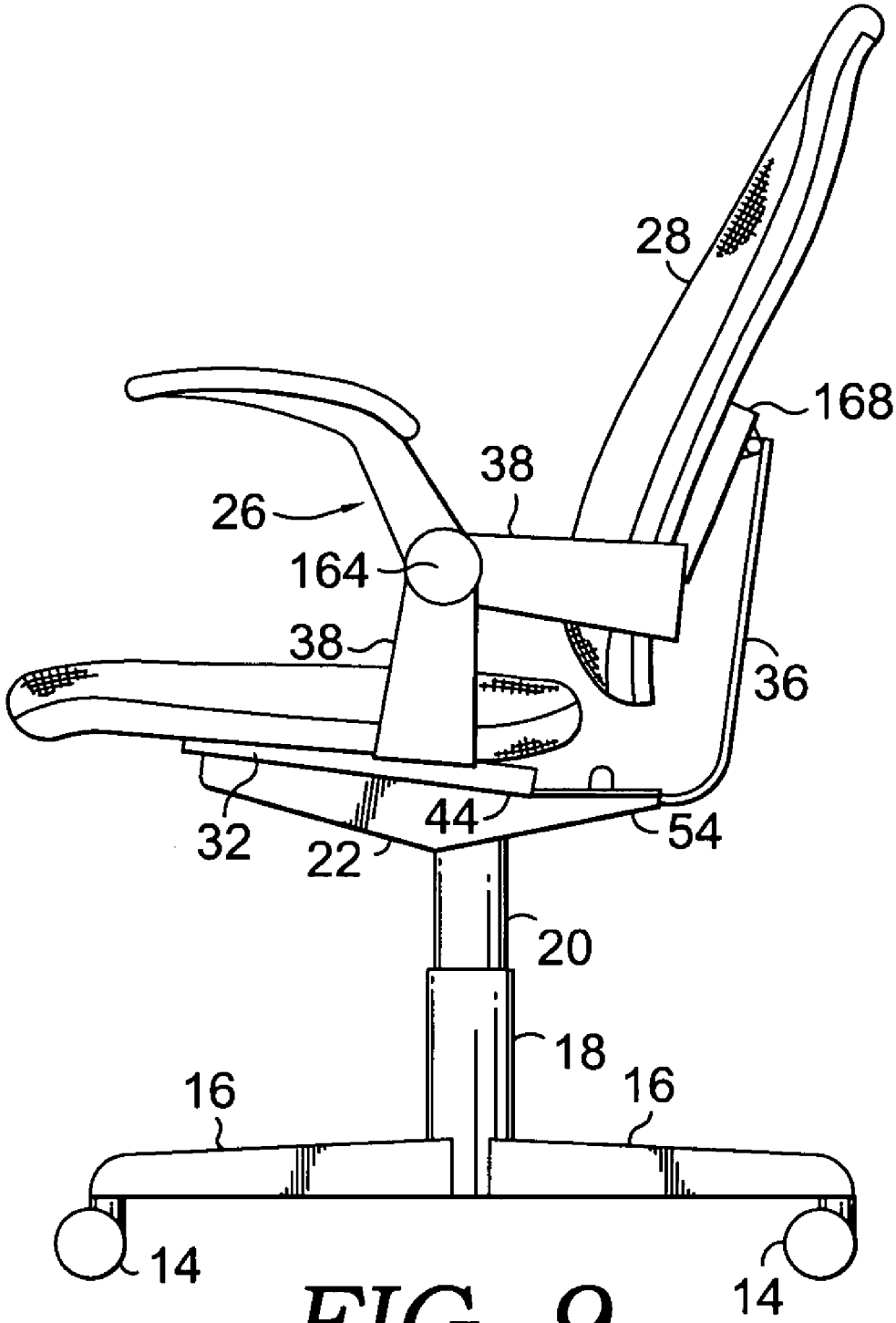
FIG. 9 is a view similar to FIG. 1, with the chair shown in the reclined position.

The operation of mechanism 30 on a chair 10 is best described with reference to FIG. 1, where the chair is shown in an upright position. FIG. 9 shows the chair in the reclined position. In use, if the occupant desires to move from the upright to the recline position, the occupant will impart a reclining force on the chair back. In other words, the occupant will lean back. When the occupant leans back, several things happen at once. First, the chair back 28 slides downwardly and rotates, as shown in FIG. 9. As best seen in FIGS. 8 and 9, the downward motion of the chair back 28 is guided by the guide plate 168. More specifically, the dovetail 178 slides upwardly in the dovetail channel 174. The back bracket 38 pivots about the pivot points 164. Again, pivot points 164 are positioned near the hip joint of the occupant. This pivoting action thus approximates the pivoting of the occupant's back with respect to the occupant's legs.

Second, as the back bracket 38 moves, the motion is transmitted into the arms 156, forcing the arms forwardly. As the arms move forwardly, the seat plate 32 also moves forwardly. Because the flanges 44 on the chassis 22 are inclined upwardly, the seat also moves slightly upwardly. As the occupant reclines, the seat moves forwardly to maintain the occupant's center of gravity generally over the column 18, thus increasing the stability of the chair. Moreover, as the occupant reclines, the lower back or "lumbar" area of the chair back follows the motion of the occupant's back. The channel 174 in guide plate 168 and the connection of the components described above achieve this guiding action. Because the flanges 42 are inclined, if the occupant wants to return to the upright position, the occupant merely sits up. As the force is relieved from the chair back, the force of gravity returns the seat 24 down the incline formed by the flanges 42. A spring 196, not shown, may be used to assist the return action. If the spring 196 is used, the spring is coupled between an upwardly extending hook 197 located on the plate 78, see FIG. 4, and a downwardly depending tab 199 on the seat plate 32, see FIG. 3.

Figure 10:
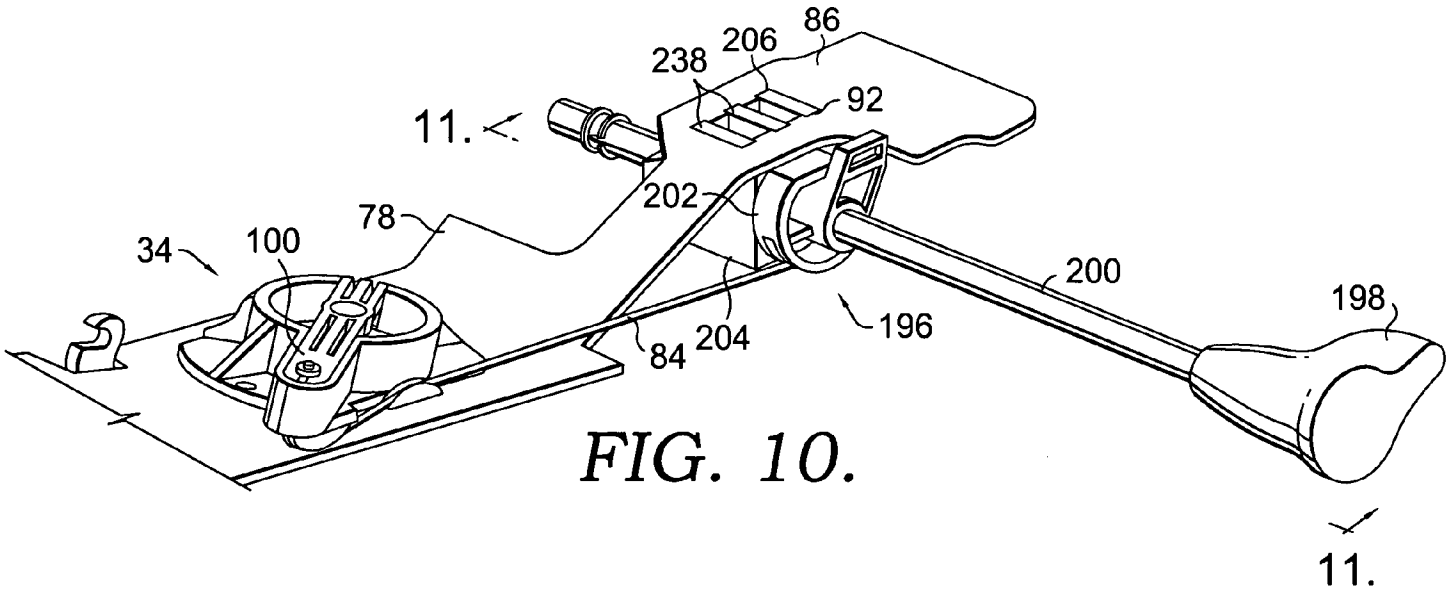
FIG. 10 is a partial, perspective view of an adjustment mechanism with an alternate embodiment of a lever mechanism.
Figure 11:
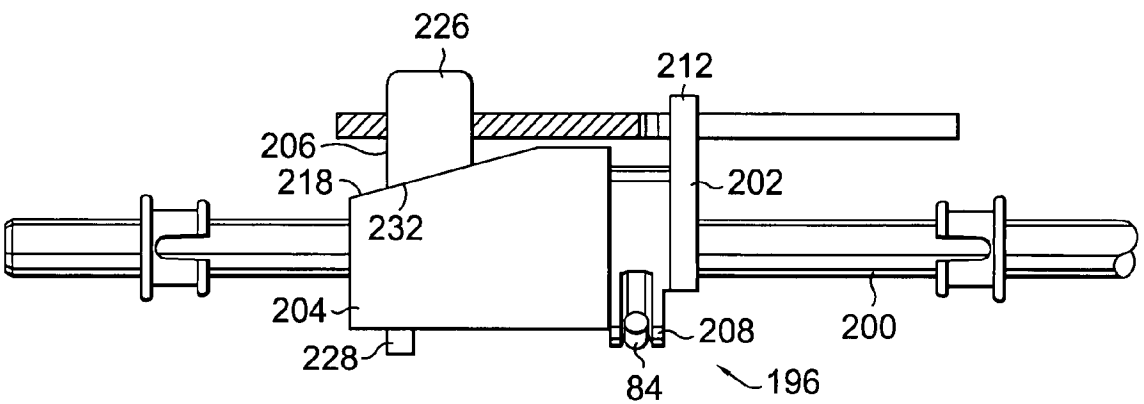
FIG. 11 is a real plan view of the alternate embodiment of the lever mechanism.

Referring now to FIGS. 10-16, an alternate embodiment of a lever mechanism 196 will be discussed. It should be understood that the lever mechanism 196 is incorporated into the adjustment mechanism 34 as previously shown in FIG. 6. The lever mechanism 196 is received in the body 42 of the chassis 22 in the same manner as the previous embodiment. Specifically, as seen in FIGS. 10 and 11, the lever mechanism 196 includes a handle 198, a shaft 200, an actuator 202, a wedge 204, and a pawl 206. The handle 198 is fixably coupled to a first end of the shaft 200.

Figure 12:
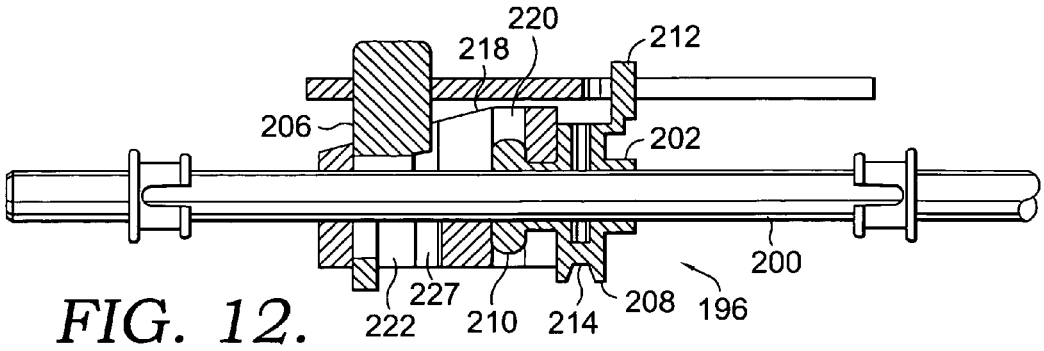
FIG. 12 is a cross-section view of the alternate embodiment of the lever mechanism taken along the line 11-11, with the pawl in the lower position.

Referring now to FIGS. 11 and 12 the actuator 202 will now be discussed. The actuator 202 is fixably mounted on the shaft 200 at an intermediate position. The actuator 202 includes an outer edge 208, a coupler 210, and a stop 212. The outer edge 208 has a channel 214 that circumscribes a portion of the underside and contains a notch 216, not shown, at an end. The notch 216 is similar to the notch 140 shown in FIG. 7 and is suitable for receipt of the second end 142, not shown, of the cable 84. The channel 214 guides the cable 84. The stop 212 serves to limit the rotation and the axial movement of the lever mechanism 196. The rotation and axial movement of the lever mechanism 196 are limited by the stop 212 and an aperture, not shown, located in the seat plate 32.

Referring now to FIGS. 11-15, the wedge 204 will be discussed. The wedge 204 is shaped as shown and includes a pair of cam surfaces 218, a first cavity 220, and a second cavity 222. The cam surfaces 218 project inwardly and taper downwardly. The cam surfaces 218 are located on each side of the second cavity 222. The first cavity 220 of the wedge 204 receives the coupler 210 from the actuator 202. Thus, as the actuator 202 is moved axially, so is the wedge 204. The wedge 204 further includes a second cavity 222 that receives the pawl 206 as will be further discussed below. The second cavity 222 includes a pair of sidewalls 224, each having a pair of recesses 225, 227.

Figure 13:
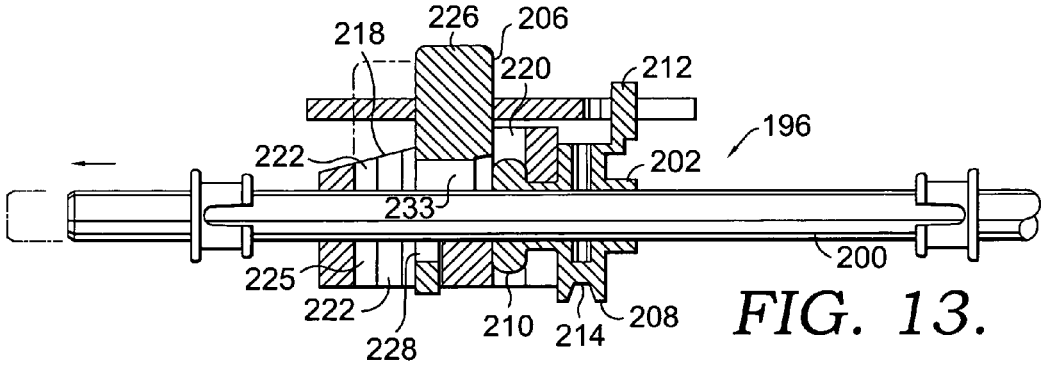
FIG. 13 is a view similar to FIG. 12, but with the pawl in the upper position.
Figure 14:
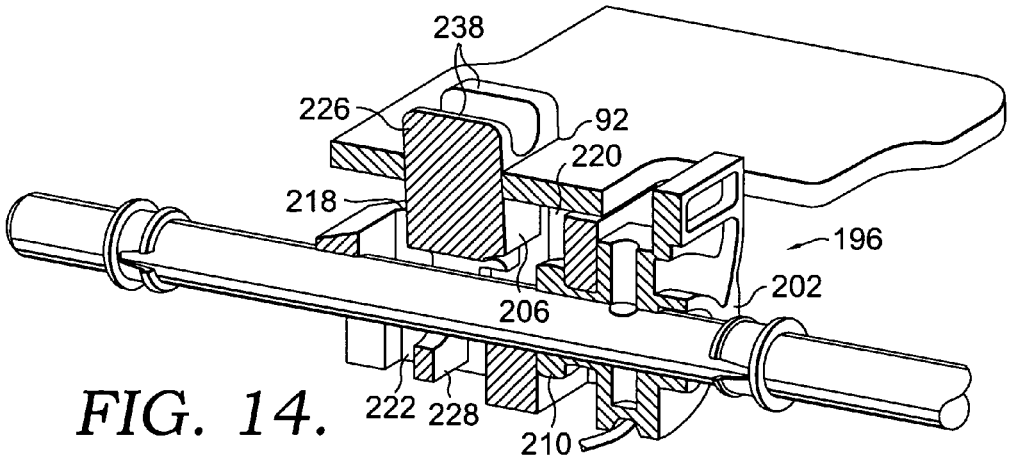
FIG. 14 is a perspective, cross-section view of the lever mechanism with the pawl in the upper position.
Figure 15:
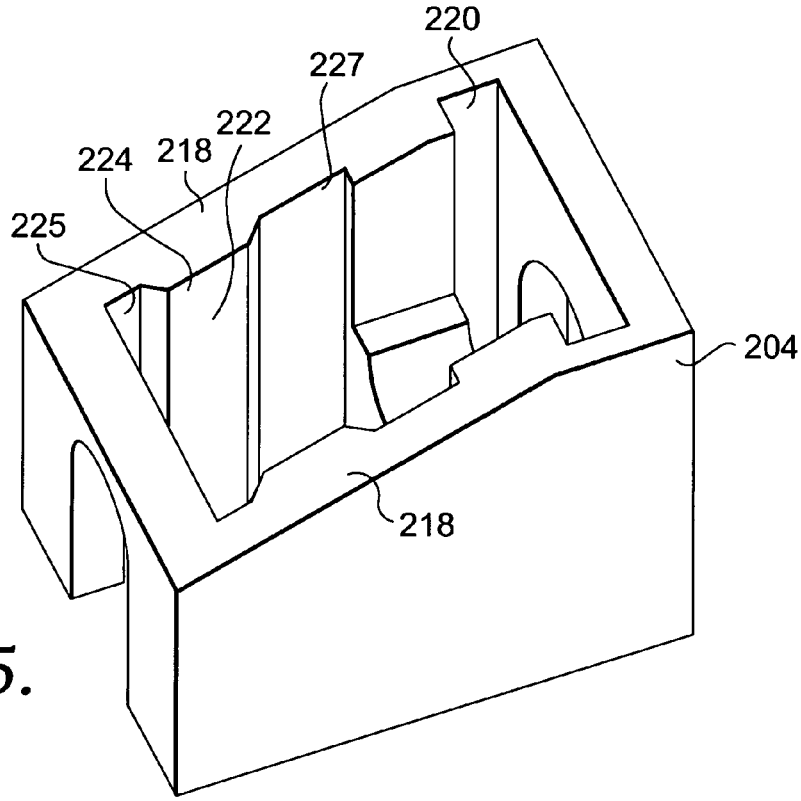
FIG. 15 is an enlarged perspective view of the wedge.
Figure 16:
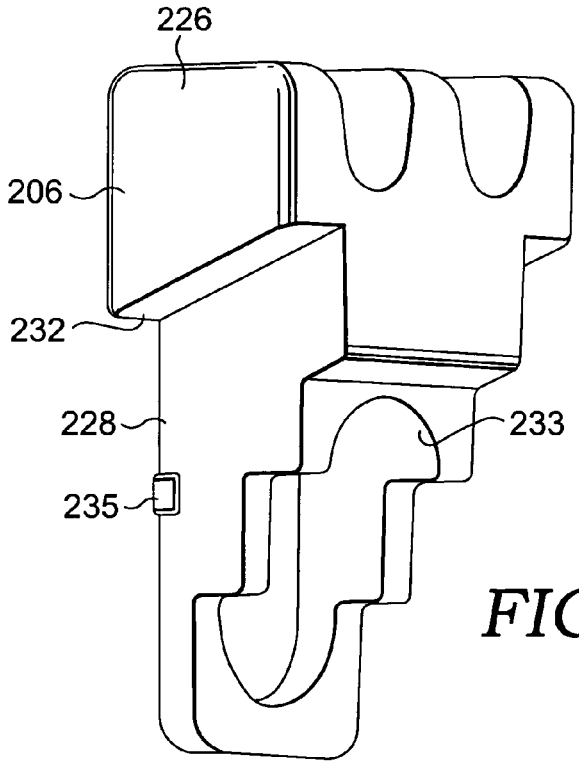
FIG. 16 is an enlarged perspective view of the pawl.

Referring now to FIGS. 11, 13, and 16, the pawl 206 will be discussed. The pawl 206 includes an upper portion 226 and a lower portion 228. The lower portion 228 contains an inner cam surface 232, an aperture 23 and a pair of notches 235 located on each side of the lower portion. The aperture 233 is sized such that the shaft 200, when moved axially, may travel therewithin. The lower portion 228 is received within the second cavity 222. The inner cam surface 232 of the pawl 206 interfaces with the cam surface 218 of the wedge 204. The pair of notches 235 mate with the recesses 225, 227 located on the sidewalls 224 of the second cavity 222. As seen in FIGS. 10 and 14, the upper portion 226 of the pawl 206 contains a plurality of vertical projections 238. The projections 238 extend upwardly from the upper portion 226 and are received within the rectangular slot 92 located in the forward portion 86 of the plate 78.

Referring now to FIGS. 10-16 the operation of the alternate embodiment will be discussed. As with the previous embodiment, the height of the chair is adjusted by rotation of the handle 198 in a counterclockwise manner. A counterclockwise rotation of the handle 198 causes a counterclockwise rotation of the actuator 202 through the shaft 200, which creates a forward pulling force on the cable 84. As previously stated, the pulling force on the cable 84 creates a downward force upon the lever 100 and engages the gas cylinder for the height adjustment.

As with the previous embodiment, the orientation of the seat plate 32 with respect to the chassis 22 is accomplished by axial movement of the handle 198 and the shaft 200. Axial movement of the handle 198 causes the cam surface 218 to contact the inner cam surface 232. As the handle 198 is pushed farther inwardly, the notches 235 disengage from the first recess 225, see FIGS. 11-13. The inward movement of the handle 198 causes the cam surface 218 of the wedge 204 to further contact the inner cam surface 232, which moves the projections 238 upwardly within the notches 94 in the rectangular slot 92. When the projections 238 move upwardly, they project above the surface of the plate 78, as seen in FIG. 10. When the handle 198 is pushed to its innermost position, the notches 235 engages the second recess 227 and the projections 238 extend through the notches 94 in the rectangular slot 92 and come into contact with the series of slots 64 in the central section 56 of the seat plate 32, see FIG. 2. Thus, by manipulating the handle 198 in the direction shown by arrow 194 the orientation of the seat plate 32 with respect to the chassis 22 may be adjusted. Further, if the user leaves the handle 198 in the innermost position where the notches 235 are in contact with the second recess 227, the seat plate 32 and, thus, the seat 24 may be locked with respect to the back 28.

To allow the seat plate 32 to move with respect to the back 28, the user simply pulls the handle 198 outwardly. The outward movement of the handle 198 causes the second ridge 225 to disengage from the groove 234 and return to its original location where it is engaged with the first ridge 224. In this position, the seat plate 32 is able to move relative to the back 28 and chassis 22.

It can be seen, therefore, that the construction provides a simple chair mechanism that is easily manufactured and that provides an occupant many advantages. The adjustment mechanism provides the user with a single lever that accomplishes the same function with regard to adjustability without multiple levers.

The present invention has been described in relation to particular embodiments, which are intended in all respects to be illustrative rather than restrictive. Alternative embodiments will become apparent to those skilled in the art to which the present invention pertains without departing from its scope.

From the foregoing, it will be seen that this invention is one well adapted to attain all the ends and objects set forth above, together with other advantages which are obvious and inherent to the system and method. It will be understood that certain features and subcombinations are of utility and may be employed without reference to other features and subcombinations. This is contemplated and within the scope of the claims.

What is claimed is:

1. A synchrotilt chair mechanism for use on a chair having a base assembly with a pedestal extending therefrom, a seat and a back, the mechanism comprising:

a chassis adapted to be coupled to the pedestal;

a seat plate slidably coupled to the chassis and adapted to be fixedly coupled to the chair seat, the seat plate having a slot;

an adjustment mechanism adapted to be received within the chassis, the adjustment mechanism including a plate having a slot, a height adjustment mechanism coupled to the plate, a lever slidably and rotatably coupled to the plate, an actuator coupled to the lever and the height adjustment mechanism and a block member received within the slot, the block member having an inner surface that contacts the actuator;

a back support bar having first and second ends, the support bar being coupled on the first end to the chassis and extending upwardly from the chassis;

a pair of arm supports adapted to be coupled to the chair, one of the arm supports extending upwardly adjacent one side of the chair seat and the other of the arm supports extending upwardly adjacent the other side of the chair seat; and a back bracket having a pair of ends, each end extending adjacent a side of the chair, each end being pivotally coupled to the adjacent arm support, the back bracket further including a guide plate adapted to be mounted to the chair back and having at least one guide slot that slidably and pivotally couples the back bracket to the second end of the back support bar;

wherein during recline of the chair, the back bracket pivots about the pivot connection on each arm support and the guide plate guides a lower back of the chair back downwardly and forwardly, and wherein during recline the chair seat slides forwardly on the chassis; and wherein rotation of the lever engages the height adjustment mechanism and changes the height of the chair relative to the base assembly and wherein axial movement of the lever causes the actuator to move the block member and selectively lock the seat plate relative to the chassis.

2. The synchrotilt mechanism of claim 1 further comprising a wedge coupled to the actuator, the wedge having a cavity and a mating surface.

3. The synchrotilt mechanism of claim 2, wherein the block member is received within the cavity.

4. The synchrotilt mechanism of claim 3, wherein the mating surface of the wedge abuts the inner surface of the block member.

5. The synchrotilt mechanism of claim 4, wherein the cavity of the wedge contains a pair of recesses.

6. The synchrotilt mechanism of claim 5, wherein the block member has a lower portion containing a pair of notches.

7. The synchrotilt mechanism of claim 6, wherein the block member includes at least one upwardly extending projection.

8. The synchrotilt mechanism of claim 7, wherein the at least one upwardly extending projection includes a plurality of upwardly extending projections.

9. The synchrotilt mechanism of claim 8, wherein the axial movement of the lever causes the upwardly extending projections to engage the slot in the seat plate and selectively lock the seat plate relative to the chassis.

10. The synchrotilt mechanism of claim 9, wherein the actuator is positioned remotely from the height adjustment mechanism.

11. The synchrotilt mechanism of claim 10, wherein the actuator is coupled to the height adjustment mechanism by a cable.

12. The synchrotilt mechanism of claim 11, wherein rotation of the lever causes the cable to engage the height adjustment mechanism to change the height of the seat relative to the base assembly.

13. An adjustment mechanism for use on a chair having a base assembly with a pedestal extending therefrom, a seat, a back, and a synchrotilt chair mechanism, the synchrotilt chair mechanism having a chassis and a seat plate, the mechanism comprising:

a plate with a slot; wherein the plate is receivable within the chassis;

a lever mechanism including:

a shaft, wherein the shaft is slidably and rotatably attachable to the chassis, a handle coupled to the shaft, an actuator coupled to the shaft, and a block member slidably received within the slot, the block member having an inner surface that abuts the actuator; and a height adjustment mechanism coupled to the plate and to the actuator via a cable;

wherein rotation of the lever mechanism engages the height adjustment mechanism and changes the height of the chair relative to the base assembly and wherein axial movement of the lever mechanism causes the actuator to move the block member and selectively lock the seat plate relative to the chassis.

14. The adjustment mechanism of claim 13 further comprising a wedge coupled to the actuator, the wedge having a cavity and a mating surface.

15. The adjustment mechanism of claim 14, wherein the block member is received within the cavity.

16. The adjustment mechanism of claim 15, wherein the mating surface of the wedge abuts the inner surface of the block member.

17. The adjustment mechanism of claim 16, wherein the cavity of the wedge contains a pair of recesses.

18. The adjustment mechanism of claim 17, wherein the block member contains a lower portion having a pair of notches.

19. The adjustment mechanism of claim 18, wherein the block member includes at least one upwardly extending projection.

20. The adjustment mechanism of claim 19, wherein the at least one upwardly extending projection includes a plurality of upwardly extending projections.

21. The adjustment mechanism of claim 20, wherein the axial movement of the lever mechanism causes the upwardly extending projections to engage the slot in the seat plate and selectively lock the seat plate relative to the chassis.

22. The adjustment mechanism of claim 21, wherein the actuator is positioned remotely from the height adjustment mechanism.

23. The adjustment mechanism of claim 22, wherein the actuator is coupled to the height adjustment mechanism by a cable.

24. The adjustment mechanism of claim 23, wherein rotation of the lever mechanism causes the cable to engage the height adjustment mechanism to change the height of the seat relative to the base assembly.

25. An adjustment mechanism for use on a chair having a base assembly with a pedestal extending therefrom, a seat, a back, and a synchrotilt chair mechanism, the synchrotilt chair mechanism having a chassis and a seat plate with a slot, the adjustment mechanism comprising:

a plate with a slot; wherein the plate is receivable within the chassis;

a lever mechanism including:

a shaft, wherein the shaft is slidably and rotatably attachable to the chassis, a handle coupled to the shaft, a cam coupled to the shaft, and a block member slidably received within the slot of the plate, the block member having an inner surface that abuts a mating surface of the cam; and a height adjustment mechanism coupled to the plate and to the cam via a cable;

wherein rotation of the lever mechanism engages the height adjustment mechanism and changes the height of the chair relative to the base and wherein axial movement of the lever mechanism causes the cam to move the block member and selectively lock the seat plate relative to the chassis.

26. The adjustment mechanism of claim 25, wherein the cam has a conical mating surface.

27. The adjustment mechanism of claim 26, wherein the mating surface of the cam contains a circumscribing ridge.

28. The adjustment mechanism of claim 27, wherein the inner surface of the block member is conical.

29. The adjustment mechanism of claim 28, wherein the inner surface of the block member has a pair of recesses.

30. The adjustment mechanism of claim 29, wherein the block member includes at least one upwardly extending projection.

31. The adjustment mechanism of claim 30, wherein the at least one upwardly extending projection includes a plurality of upwardly extending projections.

32. The adjustment mechanism of claim 31, wherein the axial movement of the lever mechanism causes the upwardly extending projections to engage the slot in the seat plate and selectively lock the seat plate relative to the chassis.

33. The adjustment mechanism of claim 32, wherein the cam is positioned remotely from the height adjustment mechanism.

34. The adjustment mechanism of claim 33, wherein the cam is coupled to the height adjustment mechanism by a cable.

35. The adjustment mechanism of claim 34, wherein rotation of the lever causes the cable to engage the height adjustment mechanism to change the height of the seat relative to the base.

* * * * *